US006275124B1

(12) United States Patent
Mendelsohn

(10) Patent No.: US 6,275,124 B1
(45) Date of Patent: Aug. 14, 2001

(54) DELAY LINE FILTER HAVING A SINGLE CROSS-COUPLED PAIR OF ELEMENTS

(75) Inventor: Joseph Patrick Mendelsohn, Englishtown, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/487,170

(22) Filed: Jan. 19, 2000

Related U.S. Application Data

(63) Continuation-in-part of application No. 09/122,274, filed on Jul. 24, 1998.

(51) Int. Cl.[7] ..... H01P 1/20; H01P 1/203; H01P 1/205

(52) U.S. Cl. ..... 333/202; 333/203; 333/204; 333/206; 333/212

(58) Field of Search ..... 333/202, 203, 333/204, 206, 208, 212

(56) References Cited

U.S. PATENT DOCUMENTS 2,984,802 * 5/1961 Dyer et al. ..... 333/204
3,737,816 * 6/1973 Honicke ..... 333/212
3,882,434 * 5/1975 Levy ..... 333/212
4,246,555 * 1/1981 Williams ..... 333/212 X
4,423,396 * 12/1983 Makimoto et al. ..... 333/204
4,890,078 * 12/1989 Radcliffe ..... 333/203 X
5,262,742 * 11/1993 Bentivenga ..... 333/206 X
5,608,363 * 3/1997 Cameron et al. ..... 333/202
5,801,605 * 9/1998 Filakovsky ..... 333/208 X
5,896,073 * 4/1999 Miyazaki et al. ..... 333/204

FOREIGN PATENT DOCUMENTS

2056528 B2 * 9/1978 (DE) ..... 333/212

* cited by examiner

*Primary Examiner*—Benny Lee
*Assistant Examiner*—Barbara Summons
(74) *Attorney, Agent, or Firm*—Jean-Marc Zimmerman

(57) ABSTRACT

A method and apparatus for implementing a delay line filter with a single cross-coupled pair of filter elements. In a first exemplary embodiment of the present invention, the filter is comprised of a plurality of symmetrically configured filter elements, wherein only two of the filter elements are cross-coupled. In a second exemplary embodiment of the present invention, the filter is comprised of a plurality of filter elements, wherein a first element is coupled to a second element, and the first and second elements are each coupled to at least two other elements and at least one of the at least two other elements for each of the first and second elements are the same.

15 Claims, 3 Drawing Sheets

DELAY LINE FILTER HAVING A SINGLE CROSS-COUPLED PAIR OF ELEMENTS

RELATED APPLICATIONS

This application is a Continuation-In-Part Application to U.S. patent application Ser. No. 09/122,274 filed on Jul. 24,1998 by Robert M. Honeycutt and Joseph P. Mendelsohn (pending).

FIELD OF THE INVENTION

This invention relates to delay line filters, and more particularly to filters with one symmetrical cross-coupled pair of filter elements.

BACKGROUND OF THE INVENTION

Filters with stringent amplitude and group delay requirements over a passband region are widely used in modern communications systems.

FIG. 1*a* shows a top view of a conventional nine element linear phase filter 10 comprised of a housing 11 having rod-shaped filter elements 12, 13, 14, 15, 16, 17, 18, 19, and 20, and metal walls 21, 22, 23, 24 and 25. Filter 10 has three cross couplings, namely between the pairs of elements 13 and 19, 14 and 18, and 15 and 17. Walls 23, 24 and 25 form a gap 26 to allow the cross coupling between filter elements 15 and 17, by allowing the coupling between the pairs of the elements 15 and 16 and 16 and 17.

In symmetrical filters, the first element to filter a signal, e.g. element 12, and the last element to filter the signal, e.g., element 20, are identical and the spacing between each of these respective elements and the elements adjacent to them are also identical. Similarly, in symmetrical filters the second and next to last filter elements. e.g., elements 13 and 19, respectively, are identical, the third and second to last filter elements, e.g., elements 14 and 18, respectively, are identical, and so on. Symmetrical filters are easier and thus less expensive to fabricate, align and tune than non-symmetrical filters since each filter half in the symmetrical filter is identical.

In filters of the type shown in FIG. 1*a,* energy is transferred between coupled filter elements, e.g., between physically adjacent elements. For example, in filter 10 shown in FIG. 1*a,* element 15 is coupled to element 16 which is coupled to element 17. A pair of filter elements are cross-coupled when each element is coupled to the other in addition to at least two other filter elements. For example, in filter 10 shown in FIG. 1*a,* element 15 is cross-coupled to element 17 because elements 15 and 17 are coupled to each other and coupled to at least two additional filter elements, for example element 15 is coupled to elements 14, 16 and 17 and element 17 is coupled to elements 15, 16 and 18. Filters having cross-coupled elements have better operating characteristics than filters having only serially coupled elements. Specifically, whereas filters having only serially coupled elements can attain either a desired amplitude flatness or a desired gain flatness but not both, filters having cross-coupled elements can attain both a desired amplitude flatness and a desired gain flatness.

FIG. 1*b* shows a top view of conventional non-symmetrical nine element linear phase filter 27 comprised of a housing 28 having rod-shaped filter elements 29, 30, 31, 32, 33, 34, 35, 36 and 37, and metal walls 38 and 39. A single cross coupling is produced between the element pair 32 and 35. As mentioned above, non-symmetrical filters are more difficult to fabricate and tune than symmetrical filters. Filter 27 has a single cross coupling which is easier to implement than a filter having multiple cross couplings. However, the single cross coupling does not overcome the aforementioned drawbacks of non-symmetrical filters. Filters having a single cross coupling are easier and thus less expensive to fabricate, align and tune than filters having multiple cross couplings.

Conventional filters of the type just described suffer from significant drawbacks. Specifically, filter 10 requires three cross couplings. Filters with multiple cross couplings are difficult to tune and are not appropriate for some applications. Filter 27 requires the use of non-adjacent element coupling and is not symmetrical.

SUMMARY

A method and apparatus for implementing a delay line filter with a single cross-coupled pair of filter elements. In a first exemplary embodiment of the present invention, the filter is comprised of a plurality of symmetrically configured filter elements, wherein only two of the filter elements are cross-coupled. In a second exemplary embodiment of the present invention, the filter is comprised of a plurality of filter elements, wherein a first element is coupled to a second element, and the first and second elements are each coupled to at least two other elements and at least one of the at least two other elements for each of the first and second elements are the same.

DETAILED DESCRIPTION OF THE INVENTION

Figure 2:
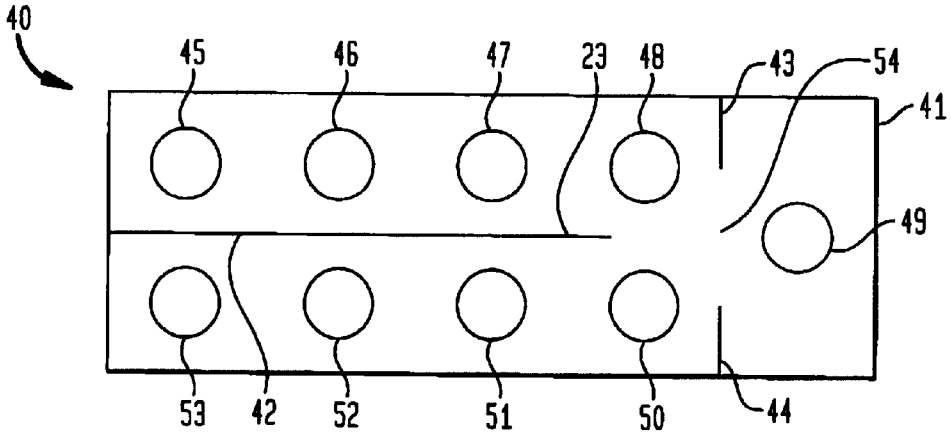
FIG. 2 shows an exemplary embodiment of a delay line filter according to the present invention that has a single symmetric cross-coupled pair of filter elements.

FIG. 2 shows a top view of an exemplary embodiment of a delay line filter 40 according to the present invention. Filter 40 is comprised of housing 41 having three walls 42, 43 and 44, and having rod-shaped filter elements 45, 46, 47, 48, 49, 50, 51, 52 and 53 positioned therein. Housing 41, walls 42, 43 and 44, and elements 45, 46, 47, 48, 49, 50, 51, 52 and 53 can be fabricated from any suitable material, including metal.

Filter elements 45, 46, 47, 48, 49, 50, 51, 52 are arranged in ((N−1)/2) columns each having two elements and a ((N+1)/2)th column having a single element, where N is the number of the elements. For filter 40, N is 9, and elements 45 and 53, 46 and 52, 47 and 51, and 48 and 50 comprise the respective ((N−1)/2) columns having two elements. Element 49 comprises the ((N+1)/2)th column.

A filter input is coupled to element 45. A filter output is coupled to element 53. Each one of the filter elements 45, 46, 47, 48, 49, 50, 51, 52 is coupled to the walls 42,43 and 44 which are each ground.

The length of each of the filter elements 45, 46, 47, 48, 49, 50, 51, 52 and 53 is ¼ of the wavelength at the center frequency of the operation. The distance between the filter input and the point at which element 45 is coupled to ground is ¼ of the wavelength long. The distance between the filter output and the point at which element 53 is coupled to ground is ¼ of the wavelength. Each element is separated from its adjacent elements by ¼ of the wavelength.

Element 45 is effectively a shunt resonator, i.e., an open circuit, to a signal presented at the input operating at the resonant frequency. Adding two resonators in series does not improve the passband performance unless they are separated by a length of the transmission line, such that the filter response is improved by adding a ¼ wavelength line segment followed by a ¼ wavelength shunt. For filter 40, filter elements 46, 47, 48, 49, 50, 51, 52, and 53, which are each separated from their adjacent elements by an electrically equivalent ¼ of the wavelength element, are added to achieve a bandpass structure with the desired frequency response.

Figure 1A:
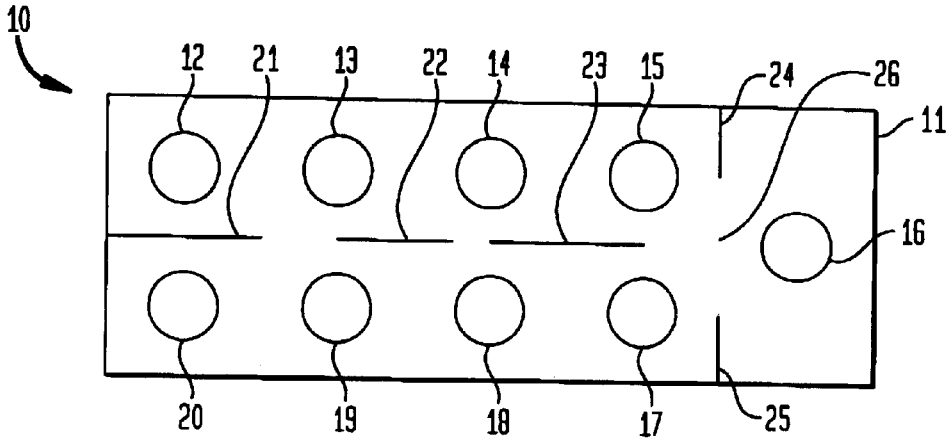
FIG. 1*a* shows a conventional delay line filter that has three symmetric cross-coupled pairs of filter elements.
Figure 1B:
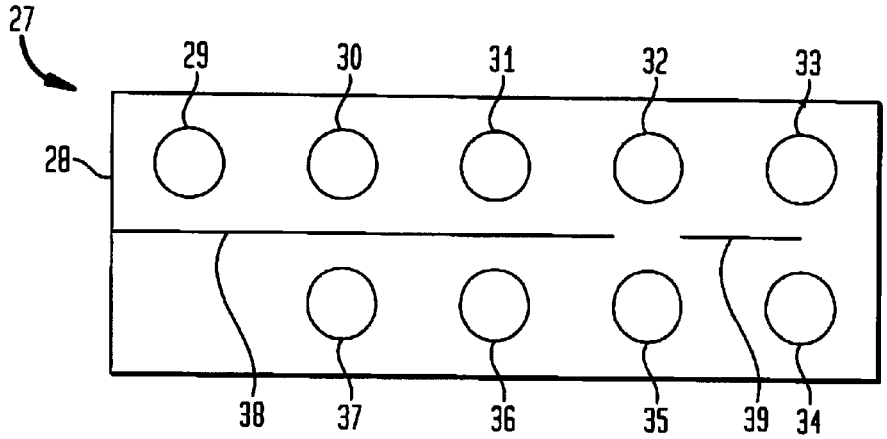
FIG. 1*b* shows a conventional delay line filter that has a single non-symmetric cross-coupled pair of filter elements.

Walls 42, 43 and 44 act as the ground isolation for filter elements 45, 46, 47, 48, 49, 50, 51, 52 and 53, and eliminate undesired cross-couplings between these elements. Walls 42, 43 and 44 form a gap 54 to allow the single cross coupling between filter elements 48 and 50, and to allow serial coupling between the pairs of elements 48 and 49 and 49 and 50, respectively. Filter elements 48, 49 and 50 operate identically to filter elements 15, 16 and 17 in filter 10 shown in FIG. 1*a*. Delay line filter 40 is thus comprised of the cross-coupling between 48 and 50, and the serial couplings between the pairs of the adjacent elements, i.e., between elements 45 and 46, between elements 46 and 47, between elements 47 and 48, between elements 48 and 49, between elements 49 and 50, between elements 50 and 51, between elements 51 and 52, and between elements 52 and 53.

The single cross-coupling between filter elements 48 and 50 enables delay line filter 40 to achieve the desired group delay requirement. Without the cross coupling, delay line filter 40 would achieve a reasonably flat amplitude response over the passband, but would fail to achieve a desirable group delay. At the center frequency of operation, the cross-coupling between elements 48 and 50 is transparent to the signal and acts like an open circuit. The group delay characteristics of the signal path via the cross-coupling are however exactly opposite of the path via the couplings between two adjacent elements. The combination of these characteristics of the cross-coupling enables delay line filter 40 to achieve a flat group delay response as well as a flat amplitude response.

Delay line filters according to the present invention can be achieved for any odd number of filter elements greater than three (3). Elements 45, 46, 47, 48, 49, 50, 51, 52 and 53 can be made from rods, bars, microstrip, stripline, airline, suspended substrate, waveguide or any other transmission line structure. The segments that separate the two adjacent elements can be implemented as any transmission line structure, or by the coupling between any two adjacent elements.

Figure 3:
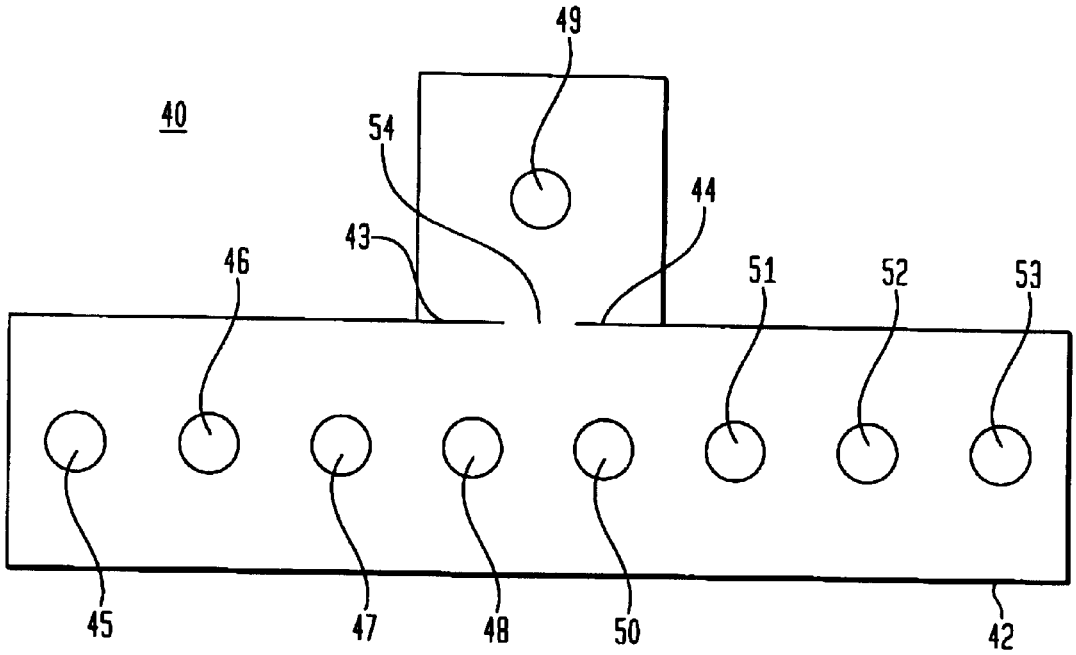
FIG. 3 shows an alternative embodiment of the filter shown in FIG. 2.

FIG. 3 shows an alternative embodiment of the filter shown in FIG. 2, wherein the numbered elements correspond to the elements shown in FIG. 2 and described above. In FIG. 3, element 48 is cross-coupled to element 50, and the following pairs of adjacent elements are serially coupled: 45 and 46; 46 and 47; 47 and 48; 48 and 49; 49 and 50; 50 and 51; 51 and 52;, 52 and 53; and 53 and 54.

Figure 4:
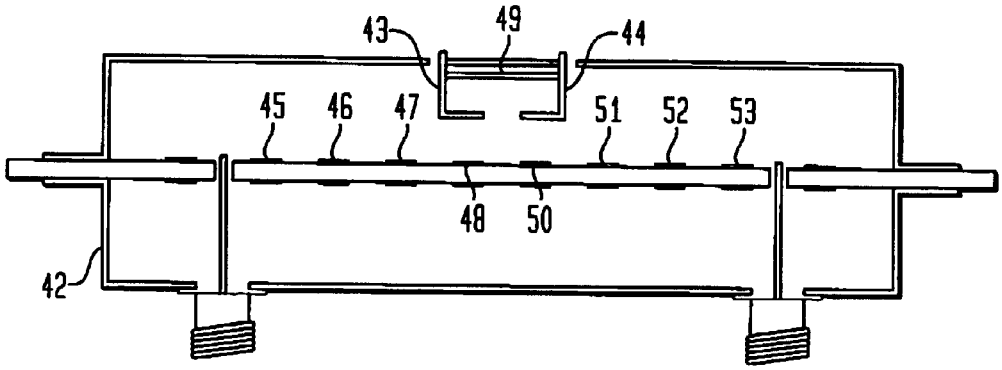
FIG. 4 shows a cross sectional view of an exemplary embodiment of the delay line filter shown in FIG. 3 implemented as an RF stripline filter.
Figure 5:
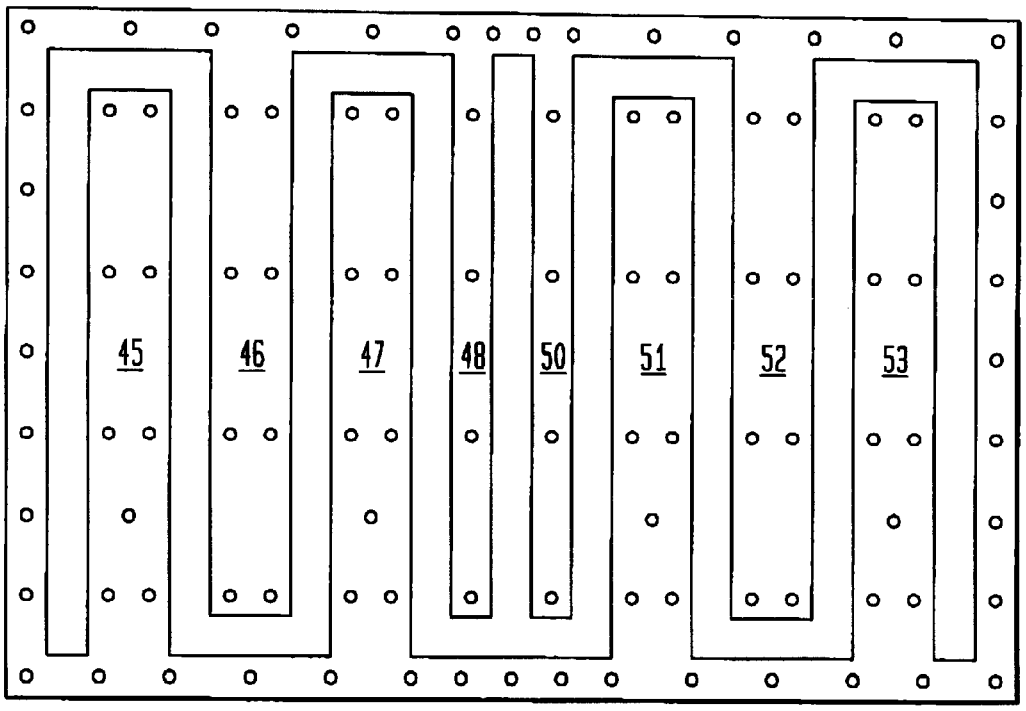
FIG. 5 shows a primary printed wiring board (PWB) for the RF stripline filter shown in FIG. 4.
Figure 6:
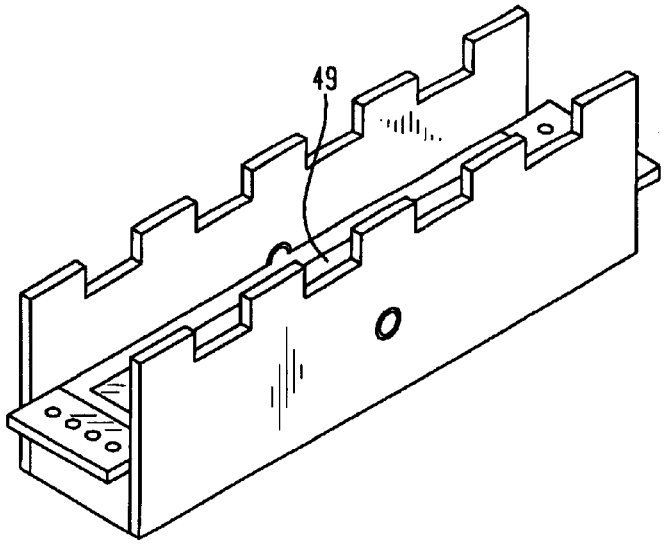
FIG. 6 shows a secondary PWB for the RF stripline filter shown in FIG. 4.

FIG. 4 shows a cross sectional view of an exemplary embodiment of delay line filter 40 shown in FIG. 3 implemented as an RF stripline filter. FIG. 5 shows a primary printed wiring board (PWB) for the RF stripline filter shown in FIG. 4. FIG. 6 shows a secondary PWB for the RF stripline filter shown in FIG. 4. The numbered elements shown in FIGS. 3, 4, 5 and 6 correspond to the elements shown in FIG. 2 and described above.

Numerous modifications to and alternative embodiments of the present invention will be apparent to those skilled in the art in view of the foregoing description. Accordingly, this description is to be construed as illustrative only and is for the purpose of teaching those skilled in the art the best mode of carrying out the invention. Details of the embodiment may be varied without departing from the spirit of the invention, and the exclusive use of all modifications which come within the scope of the appended claims is reserved.

What is claimed is:

1. A method for implementing a delay line filter, comprising the steps of:

positioning an odd number of filter elements into a plurality of columns having two filters elements and a single column having a single filter element; and positioning a plurality of partitions between certain ones of the filter elements to provide a single cross-coupled pair of filter elements, wherein each one of the filter elements each has a transmission line structure, and the plurality of partitions are comprised of a first wall, a second wall, and a third wall.

2. The method according to claim 1, wherein the delay line filter has a center frequency of operation, and the distance between the filter element in the single column and each of the filter elements in the one of the plurality of columns adjacent to the single column is ¼ of the wavelength of the center frequency of operation.

3. The method according to claim 2, wherein the single cross-coupling occurs between the filter elements in the column adjacent to the single column.

4. A delay line filter, comprising:

an odd number of elements N greater than three, said elements positioned in (N−1)/2 columns having two elements and a ((N+1)/2)th column having a single element; and a first wall, a second wall, and a third wall positioned between certain ones of the elements to produce a single cross-coupled pair of elements.

5. The delay line filter according to claim 1, wherein the N elements each have a transmission line structure.

6. The filter according to claim 5, wherein the delay line filter has a center frequency of operation, and the element in the ((N+1)/2)th column is separated from each of the elements in the adjacent column by ¼ of the wavelength of the center frequency of operation.

7. The delay line filter according to claim 6, wherein the single cross-coupling occurs between the elements in the column adjacent to the ((N+1)/2)th column.

8. The delay line filter according to claim 7, wherein the first wall prevents a cross-coupling between the elements in each of the columns that are non-adjacent to the ((N+1)/2)th column.

9. The delay line filter according to claim 8, wherein the second wall prevents a cross-coupling between the element in the ((N+1)/2)th column and a first element in the column adjacent to the ((N+1)/2)th column, and the third wall prevents a cross-coupling between the element in the ((N+1)/2)th column and the second element in the column adjacent to the ((N+1)/2)th column.

10. A method for implementing a delay line filter, comprising the steps of:

positioning an odd number of elements N greater than three in (N-1)/2columns having two elements and a ((N+1)/2)th column having a single element; and positioning a first wall, a second wall, and a third wall between certain ones of the elements to produce a single cross-coupled pair of elements.

11. The method according to claim 10, wherein the elements each have a transmission line structure.

12. The delay line filter according to claim 11, wherein the delay line filter has a center frequency of operation, and the element in the ((N+1)/2)th column is separated from each of the elements in the adjacent column by ¼ of the wavelength of the center frequency of operation.

13. The method according to claim 12, wherein the cross-coupling is produced between the elements in the column adjacent to the ((N+1)/2)th column.

14. The method according to claim 13, wherein the first metal wall prevents a cross-coupling between the elements in each of the columns nonadjacent to the ((N+1)/2)th column.

15. The method according to claim 14, wherein the second metal wall prevents a cross-coupling between the element in the ((N+1)/2)th column and a first element in the column adjacent to the ((N+1)/2)th column, and the third metal wall prevents a cross-coupling between the element in the ((N+1)/2)th column and the second element in the column adjacent to the ((N+1)/2)th column.

* * * * *